US011270879B2

(12) United States Patent
Oda et al.

(10) Patent No.: US 11,270,879 B2
(45) Date of Patent: Mar. 8, 2022

(54) EXCIMER LAMP LIGHT SOURCE DEVICE

(71) Applicant: Ushio Denki Kabushiki Kaisha, Tokyo (JP)

(72) Inventors: Koji Oda, Tokyo (JP); Junya Asayama, Tokyo (JP); Masashi Okamoto, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/290,875

(22) PCT Filed: Nov. 8, 2019

(86) PCT No.: PCT/JP2019/043845
§ 371 (c)(1),
(2) Date: May 3, 2021

(87) PCT Pub. No.: WO2020/100733
PCT Pub. Date: May 22, 2020

(65) Prior Publication Data

US 2021/0313165 A1 Oct. 7, 2021

(30) Foreign Application Priority Data

Nov. 13, 2018 (JP) ..... JP2018-212627

(51) Int. Cl.
*H01J 65/00* (2006.01)
*H05B 41/24* (2006.01)

(52) U.S. Cl.
CPC ..... *H01J 65/00* (2013.01); *H05B 41/24* (2013.01)

(58) Field of Classification Search
CPC ..... H01J 65/00; H05B 41/24; H05B 41/19; H05B 41/22; H05B 41/23; H05B 41/231;
(Continued)

(56) References Cited

U.S. PATENT DOCUMENTS 6,084,360 A 7/2000 Yokokawa et al.
6,239,559 B1 5/2001 Okamoto et al.
(Continued)

FOREIGN PATENT DOCUMENTS

JP H04-280059 A 10/1992
JP H09-180685 A 7/1997
(Continued)

OTHER PUBLICATIONS

International Search Report issued in PCT/JP2019/043845; dated Feb. 10, 2020.
(Continued)

*Primary Examiner* — Renan Luque
(74) *Attorney, Agent, or Firm* — Studebaker & Brackett PC

(57) ABSTRACT

Provided is an excimer lamp light source device that achieves low cost and avoids the occurrence of narrowly-defined contracted discharge by adopting a lamp bulb having a simple structure and of the type in which a discharge current is passed in a tube axis direction.

The excimer lamp light source device includes: an excimer lamp that has a pair of external electrodes configured to induce an electric discharge in a discharge space of a lamp bulb and to cause a discharge current to flow in a tube axis direction of the lamp bulb, and that generates UV light in the discharge space by the discharge; and an inverter having a transformer equipped with a secondary winding to which the external electrodes are connected in order to apply a high-voltage alternating current to the excimer lamp, the inverter supplying power lower than power that causes a linear discharge.

5 Claims, 9 Drawing Sheets

(58) Field of Classification Search
CPC ..... H05B 41/232; H05B 41/2325; H05B 41/2806
See application file for complete search history.

(56) References Cited

U.S. PATENT DOCUMENTS

| | | | |
|---|---|---|---|
| 6,356,033 | B1 | 3/2002 | Okamoto et al. |
| 6,445,137 | B1 | 9/2002 | Okamoto et al. |
| 2004/0239260 | A1 | 12/2004 | Nakano |
| 2004/0256968 | A1 | 12/2004 | Kurita et al. |
| 2005/0194903 | A1 | 9/2005 | Minamoto et al. |
| 2006/0055326 | A1 | 3/2006 | Takeda et al. |
| 2007/0274078 | A1 | 11/2007 | Matsubayashi et al. |
| 2009/0046223 | A1* | 2/2009 | Hashimotodani .. H05B 41/2827 349/70 |

FOREIGN PATENT DOCUMENTS

| | | | | |
|---|---|---|---|---|
| JP | 2854250 | B2 | | 2/1999 |
| JP | H11-354079 | A | | 12/1999 |
| JP | 2000-223079 | A | | 8/2000 |
| JP | 3149780 | B2 | | 3/2001 |
| JP | 3296284 | B2 | | 6/2002 |
| JP | 3353684 | B2 | | 12/2002 |
| JP | 3355976 | B2 | | 12/2002 |
| JP | 2003-100482 | A | | 4/2003 |
| JP | 2004-022209 | A | | 1/2004 |
| JP | 2004-079270 | A | | 3/2004 |
| JP | 2004-127540 | A | | 4/2004 |
| JP | 3521731 | B2 | | 4/2004 |
| JP | 2004-146351 | A | | 5/2004 |
| JP | 2004-179059 | A | | 6/2004 |
| JP | 2005-011710 | A | | 1/2005 |
| JP | 2005-174632 | A | | 6/2005 |
| JP | 2005-267908 | A | | 9/2005 |
| JP | 2005-327659 | A | | 11/2005 |
| JP | 2006-019100 | A | | 1/2006 |
| JP | 2006-079830 | A | | 3/2006 |
| JP | 2006-085983 | A | | 3/2006 |
| JP | 2006-338897 | A | | 12/2006 |
| JP | 2006-351541 | A | | 12/2006 |
| JP | 2007-035462 | A | | 2/2007 |
| JP | 2007-053117 | A | | 3/2007 |
| JP | 2008-243521 | A | | 10/2008 |
| JP | 2008-262805 | A | | 10/2008 |
| JP | 2010179240 | A | * | 8/2010 |
| JP | 2010198936 | A | * | 9/2010 |
| JP | 2014-030763 | A | | 2/2014 |
| JP | 2016081695 | A | * | 5/2016 |
| KR | 20090080887 | A | * | 7/2009 |
| WO | 2005057611 | A1 | | 6/2005 |
| WO | 2008038527 | A1 | | 4/2008 |

OTHER PUBLICATIONS

"Decision to Grant" Office Action issued in JP 2019-563636; mailed by the Japanese Patent Office dated Jun. 2, 2020.

"Notice of Reasons for Refusal" Office Action issued in JP 2019-563636; mailed by the Japanese Patent Office dated Feb. 4, 2020.

Notification of Transmittal of Translation of the International Preliminary Report on Patentability and Translation of Written Opinion of the International Searching Authority; PCT/JP2019/043845; dated May 27, 2021.

* cited by examiner (a)

(b)

(a)

(b)

EXCIMER LAMP LIGHT SOURCE DEVICE

TECHNICAL FIELD

The present invention relates to an excimer lamp light source device that includes an excimer lamp being a suitable light source in constituting a device that generates ultraviolet (UV, ultraviolet region) light usable in the fields of, for example, UV ozone cleaning, UV ozone deodorizing, UV surface modification, UV curing, UV sterilization, and others, or converts the wavelength of the generated UV light into other wavelengths, and emits the light, and an inverter that lights the excimer lamp.

BACKGROUND ART

Regarding the excimer lamp light source device, for example, as described, in JP-B2-2854250, JP-B2-3296284, JP-B2-3353684, JP-B2-3355976, JP-B2-3521731 and the like, by the applicant of the present invention, technological development has been carried out to strongly drive excimer lamps and obtain UV emission with high efficiency to the utmost limit. The motive thereof is made in consideration for application in commercial equipment that can be used in factories and the like.

As described in (a) and (c) of FIG. 1 of JP-B2-3355976, tubular excimer lamps in which a current passes in a direction perpendicular to a tube axis (that is, in a diameter direction or radial direction of a tube) are the mainstream.

On the other hand, in contrast to these, the UV light sources used for UV sterilization, UV deodorization or the like, in ordinary households are relatively small-scale light source devices, and therefore, high efficiency to the utmost limit is not required. Instead, the devices may be required to be commercialized at the lowest possible cost, and for such applications, the techniques described in the above-described documents have not always been optimal.

In the case of a lamp such as an excimer lamp that uses external electrodes, the lamp that can be commercialized at the lowest cost is the one of a type in which a simple cylindrical glass tubular body is filled with a discharge medium and both tube ends are hermetically sealed to form a lamp bulb, external electrodes composed of ring-shaped or cap-shaped conductors are provided near both of the sealed tube ends, and a discharge current is passed in a direction of a tube axis of the glass tube (hereinafter, "a type in which a discharge current is passed in the tube axis direction" refers to this type).

The reason for why this type of lamp can be manufactured at low cost is that the structure of the lamp bulb is simple. Therefore, a large number of this type of lamp have been proposed since past time.

Although there are technologies described in, for example, JP-A-2003-100482, JP-A-2004-022209, JP-A-2004-079270, JP-A-2004-146351, JP-A-2004-179059, JP-A-2005-011710, JP-A-2005-267908, JP-A-2006-019100, JP-A-2006-085983, JP-A-2007-053117, and others, almost all of these types practically contain mercury as a discharge medium (some of techniques do not exclude those that do not contain mercury, but only those that contain mercury are listed in the examples).

There is a reason that most of this type of lamps are mercury lamps. The reason is that lamps that allow the discharge current to flow in the tube axis direction of the glass tube tends to have a longer discharge path than lamps that allow the discharge current to flow in the direction perpendicular to the tube axis. By having mercury vapor in the glass tube to make the current flow easily (Penning effect), a required level of applied voltage can be kept within the practical range.

However, it is not appropriate to use a light source containing harmful mercury for household appliances that are used with food, beverages, clothing or the like, as described above.

On the other hand, in the excimer lamp, a rare gas or mixed gas of the rare gas and halogen is used as the discharge gas and the content of mercury can be avoided. Because of this, in attempting to actualize the lamp of the type in which a discharge current is passed in the tube axis direction, while the required length as a lamp bulb suitable for the application is provided and the applied voltage is suppressed within a practical range, the pressure of the gas to be filled needs to be very low. Therefore, this causes a problem that the efficiency of UV emission is lowered.

However, as described above, in the assumption of being used in the devices, such as in the household appliances which does not require high efficiency to the utmost limit and whose size is relatively small or length of the lamp bulb can be made relatively short, practicality can also be found in the excimer lamp of the type in which the discharge current is passed in the tube axis direction.

Therefore, the inventors of the present invention created an excimer lamp of the type in which the discharge current is passed in the tube axis direction and having a lamp bulb structure as described in JP-A-2005-267908 (however, a phosphor film, a magnesium oxide film, and mercury described in JP-A-2005-267908 were not contained) as a preliminary test lamp.

The configuration is as shown in FIG. 14, which is a schematic diagram of a concept related to a technique of an excimer lamp light source device of the present invention.

The excimer lamp (Y') was created by filling a discharge space (Yg'), being surrounded by a lamp bulb (Yt') and a hermetically sealed part (Ys') at both ends, with xenon gas at an appropriate pressure, and by arranging external electrodes (Ye1', Ye2') each formed by winding a strip-shaped metal plate.

However, as described in JP-B2-3149780, based on the finding that it is possible to reduce the applied voltage for starting the discharge by arranging a conductive substance on a part of the inner surface of the lamp bulb, a carbon paste film forming region as an easily dischargeable substance layer was formed on the inner surface of one end of the lamp bulb.

In FIG. 14, the carbon paste film forming region is not shown in order to prevent the drawing elements from overlapping and becoming difficult to see.

Then, when an inverter that generates a high-voltage alternating current (AC) was connected to the external electrodes (Ye1', Ye2'), the preliminary test lamp was turned on, and an intensity of the generated UV light was measured, it has been found that the intensity was far from the expected practical intensity, and the UV emission efficiency with respect to the input power to the lamp was extremely low.

As a result of observation of the discharge state of the preliminary test lamp in order to investigate the cause, the initial prediction was that a diffused discharge (Gd') would be generated, which is a discharge generated in the discharge space in the lamp bulb in a uniform manner over a space surrounded by the two ring-shaped external electrodes and the entire volume located therebetween as shown in (a) of FIG. 14. However, a narrowly-defined contracted discharge (Gs') being a thin linear discharge as shown in (b) of FIG.

14 was generated. Note that this term "narrowly-defined contracted discharge" is described later.

Because this lamp is intended for UV application and not for general lighting, there is no problem in that the linear narrowly-defined contracted discharge (Gs') is generated.

However, if there is a causal relationship between this narrowly-defined contracted discharge (Gs') and the extremely low UV emission efficiency, the narrowly-defined contracted discharge (Gs') needs to be avoided and the diffused discharge (Gd') needs to be surely generated.

Additionally, the shape of the discharge path of the narrowly-defined contracted discharge (Gs') was various, in some cases wound and in some cases close to a straight line, but the shape was mainly recognized as a single bright line.

When the narrowly-defined contracted discharge was generated, the diffused discharge was generated in a partial space whose outer side is surrounded by the external electrodes (Ye1', Ye2') within the inner region of the lamp bulb (Yt').

Although boundary points defining a range of the discharge path of the narrowly-defined contracted discharge (Gs') are not always clear, the ends of the narrowly-defined contracted discharge (Gs') appeared to be almost in contact with the inner surface of the lamp bulb (Yt') facing the portions whose outer side is surrounded by the external electrodes (Ye1', Ye2').

In the discharge space (Yg') between the external electrodes (Ye1', Ye2') on both sides, the discharge path of the narrowly-defined contracted discharge (Gs') is not in contact with the inner surface of the lamp bulb (Yt') in many cases. Therefore, the narrowly-defined contracted discharge (Gs') is not due to creeping discharge.

Now, the term "narrowly-defined contracted discharge" is described.

The expression "contracted discharge" also appears in many of the prior art documents described below, but the characteristics thereof in the prior art are different from those of the thin linear discharge described here.

Therefore, for the purpose of avoiding confusion, the thin linear discharge described here is called the narrowly-defined contracted discharge to distinguish the term from those in the prior art.

In the present description, the "narrowly-defined contracted discharge" is defined to indicate discharge, in an excimer lamp of a type in which a lamp bulb has both ends of a tubular body being hermetically sealed and has an easily dischargeable substance layer formed on a surface in contact with a discharge space, and which does not have an internal electrode, passes a discharge current in the tube axis direction, and has a pair of external electrodes, the discharge being a discharge that mainly has a form consisting of one linear discharge path that extends from the vicinity of an inner surface portion of the lamp bulb facing a portion of the lamp bulb which one of the external electrodes is close to or in contact with, to the vicinity of the inner surface portion of the lamp bulb facing a portion of the lamp bulb which the other of the external electrodes is close to or in contact with.

Note that the reason why it is described as "mainly" is that, in addition to the discharge having the form consisting of one linear discharge path described above, although it is very rare, there may be the case in which the discharge has a plurality of linear discharge paths from one to the other of the external electrode-facing inner surface portions (the vicinity of the inner surface portions of the lamp bulb facing the portions of the lamp bulb which the external electrodes are close to or in contact with, as described above is hereinafter abbreviated as this term), in which the discharge extends in the discharge space as linear discharge paths from two distant locations of one of the external electrode-facing inner surface portions and the two linear discharge paths join into one in the middle to form a Y-shape in entirety, or still further, in which the linear discharge path appears from one of the external electrode-facing inner surface portion to the portion in the middle of the discharge space and becomes diffused discharge from that point to the other of the external electrode-facing inner surface portion.

In the present invention, the discharge having the rare appearing linear discharge paths as such are also referred to as the narrowly-defined contracted discharge.

As documents referring to contracted discharge in an excimer lamp, WO 2005/057611, JP-A-2005-174632, JP-A-2006-351541, JP-A-2008-243521, and JP-A-2008-262805 describe a dielectric barrier discharge fluorescent lamp having internal and external electrodes and using a rare gas such as xenon as a discharge medium. The documents propose a technique of, while the contracted discharge is allowed to be generated near the internal electrode, fixing the contracted discharge in order to prevent flicker of the brightness of the lamp (harmful as a fluorescent lamp for illumination) caused by temporal change of the position where the contracted discharge is generated.

JP-A-2006-079830 describes a dielectric barrier discharge fluorescent lamp having internal and external electrodes and using a rare gas such as xenon as a discharge medium, in which a technique to suppress the generation of contracted discharge by dividing the electrode into a plurality of pieces is proposed.

WO 2008/038527 describes a dielectric barrier discharge fluorescent lamp having internal and external electrodes and using a rare gas mainly composed of xenon as a discharge medium, in which there is a description that when the applied voltage is increased, the contracted discharge state occurs in the vicinity of the internal electrode.

JP-A-2005-327659 describes a dielectric barrier discharge fluorescent lamp having internal and external electrodes and using a rare gas mainly composed of xenon as a discharge medium, in which there is a description that the contracted discharge is more likely to be generated as the current increases.

JP-A-2006-338897 describes a dielectric barrier discharge fluorescent lamp having internal and external electrodes and using a rare gas mainly composed of xenon as a discharge medium, in which there is a description that when the applied voltage is increased, the state shifts to the contracted discharge state near the internal electrode, and that as the operating frequency of an inverter decreases, the contracted discharge is less likely to be generated near the internal electrode.

JP-A-2000-223079 describes a dielectric barrier discharge fluorescent lamp of a type in which the current is passed in a direction orthogonal to the tube axis, which has a pair of strip-shaped external electrodes extending in the longitudinal direction of a tubular lamp bulb or has a linear internal electrode located at the central axis of the tubular lamp bulb and a strip-shaped external electrode, rather than the type in which the discharge current is passed in the tube axis direction, and using a rare gas mainly composed of xenon as a discharge medium. The document describes that when the gas pressure of xenon gas is increased, a phenomenon occurs in which the discharge contracts, and this contraction causes innumerable whisker-like discharges.

JP-A-2014-030763 describes an excimer lamp of a type in which the current is passed in a direction orthogonal to the tube axis, which has a pair of strip-shaped external electrodes extending in the longitudinal direction of a tubular lamp bulb, rather than the type in which the discharge current is passed in the tube axis direction, and using xenon and iodine as discharge media. The document describes that when the xenon partial pressure is increased while the iodine partial pressure is kept constant, the diffused discharge is generated in a low voltage region lower than 12 kV, but a plurality of filament discharges are generated when the pressure becomes higher than the region.

Most of the documents referring to the contracted discharge in the excimer lamps mentioned above are for the lamps of the type having internal and external electrodes, and all the documents describing the position where the contracted discharge is generated describes that the contracted discharge is generated near the internal electrode. Further, there is no information on the number of lines of contracted discharge; therefore, these cases do not apply to the narrowly-defined contracted discharge (Gs') whose number of lines of discharge is mainly one, in the excimer lamp (Y') not having the internal electrode.

Regarding the lamp having no internal electrode and only the external electrode, there is information available only for the lamp of the type in which the current is passed orthogonal to the tube axis direction, rather than the type in which the discharge current is passed in the tube axis direction. Besides, there is only description of "innumerable whisker-like discharges are generated" or "plurality of filament discharges are generated", which does not apply to the narrowly-defined contracted discharge (Gs') whose number of lines of discharge is mainly one, in the excimer lamp (Y').

Therefore, there is no information on the contracted discharge corresponding to the narrowly-defined contracted discharge (Gs') in the excimer lamp of the type having only the external electrode and passing the discharge current in the tube axis direction, which is of interest in the present invention.

Further, as described above, there is information available only on the lamp that contains mercury, in the type of lamp having only the external electrode and passing the discharge current in the tube axis direction.

PRIOR ART DOCUMENT

Patent Documents

Patent Document 1: JP-B2-2854250
Patent Document 2: JP-B2-3296284
Patent Document 3: JP-B2-3353684
Patent Document 4: JP-B2-3355976
Patent Document 5: JP-B2-3521731
Patent Document 6: JP-A-2003-100482
Patent Document 7: JP-A-2004-022209
Patent Document 8: JP-A-2004-079270
Patent Document 9: JP-A-2004-146351
Patent Document 10: JP-A-2004-179059
Patent Document 11: JP-A-2005-011710
Patent Document 12: JP-A-2005-267908
Patent Document 13: JP-A-2006-019100
Patent Document 14: JP-A-2006-085983
Patent Document 15: JP-A-2007-053117
Patent Document 16: JP-B2-3149780
Patent Document 17: WO 2005/057611
Patent Document 18: JP-A-2005-174632
Patent Document 19: JP-A-2006-351541
Patent Document 20: JP-A-2008-243521
Patent Document 21: JP-A-2008-262805
Patent Document 22: JP-A-2006-079830
Patent Document 23: WO 2008/038527
Patent Document 24: JP-A-2005-327659
Patent Document 25: JP-A-2006-338897
Patent Document 26: JP-A-2000-223079
Patent Document 27: JP-A-2014-030763
Patent Document 28: JP-A-09-180685
Patent Document 29: JP-A-11-354079

SUMMARY OF THE INVENTION

Problems to be Solved by the Invention

An object of the present invention is to provide an excimer lamp light source device that achieves low cost and avoids the occurrence of narrowly-defined contracted discharge by adopting a lamp bulb having a simple structure and of the type in which a discharge current is passed in a tube axis direction and without having an internal electrode.

Means for Solving the Problems

An excimer lamp light source device according to a first aspect of the present invention includes:

an excimer lamp (Y) that has a pair of external electrodes (Ye1, Ye2) configured to induce an electric discharge in a discharge space (Yg) of a lamp bulb (Yt) and to cause a discharge current to flow in a tube axis direction of the lamp bulb (Yt), and that generates UV light in the discharge space (Yg) by the discharge, the lamp bulb (Yt) enclosing the discharge space (Yg) filled with a discharge gas configured to generate xenon excimer molecules, having a shape in which both ends of a tubular body are hermetically sealed, and having an easily dischargeable substance layer (Yo) that can easily cause a discharge formed on at least a part of a surface that is in contact with the discharge space (Yg); and an inverter (Ui) having a transformer (Tf) equipped with a secondary winding (Ls) to which the external electrodes (Ye1, Ye2) are connected in order to apply a high-voltage alternating current to the excimer lamp (Y).

The inverter (Ui) supplies power lower than power that causes a narrowly-defined contracted discharge to the excimer lamp (Y) to light the excimer lamp (Y) in a discharge state that is not the narrowly-defined contracted discharge.

The narrowly-defined contracted discharge being a discharge that mainly has a form consisting of one linear discharge path extending from a vicinity of an inner surface portion of the lamp bulb (Yt) facing a portion of the lamp bulb (Yt) which one of the external electrodes (Ye1, Ye2) is close to or in contact with, to a vicinity of the inner surface portion of the lamp bulb (Yt) facing a portion of the lamp bulb (Yt) which the other of the external electrodes (Ye1, Ye2) is close to or in contact with.

In the excimer lamp light source device according to a second aspect of the present invention, the pair of external electrodes (Ye1, Ye2) have an inter-electrode distance (Le), which is measured along an outer surface of the lamp bulb (Yt) and is a minimum value of a distance between each other, of a value that is selected from within a region of the inter-electrode distance (Le) where a minimum value of power that generates the narrowly-defined contracted discharge increases or saturates to increase when the inter-electrode distance (Le) is increased, the minimum value of power being determined according to the inter-electrode distance (Le).

In the excimer lamp light source device according to a third aspect of the present invention, a ratio of a power value causing the narrowly-defined contracted discharge to a lamp input power value during normal operation is 105% to 120%.

An excimer lamp lighting method according to a fourth aspect of the present invention is an excimer lamp lighting method in an excimer lamp light source device including:

an excimer lamp (Y) that has a pair of external electrodes (Ye1, Ye2) configured to induce an electric discharge in a discharge space (Yg) of a lamp bulb (Yt) and to cause a discharge current to flow in a tube axis direction of the lamp bulb (Yt), and that generates UV light in the discharge space (Yg) by the discharge, the lamp bulb (Yt) enclosing the discharge space (Yg) filled with a discharge gas configured to generate xenon excimer molecules, having a shape in which both ends of a tubular body are hermetically sealed, and having an easily dischargeable substance layer (Yo) that can easily cause a discharge formed on at least a part of a surface that is in contact with the discharge space (Yg); and an inverter (Ui) having a transformer (Tf) equipped with a secondary winding (Ls) to which the external electrodes (Ye1, Ye2) are connected in order to apply a high-voltage alternating current to the excimer lamp (Y).

The inverter (Ui) supplies power lower than power that causes a narrowly-defined contracted discharge to the excimer lamp (Y) to light the excimer lamp (Y) in a discharge state that is not the narrowly-defined contracted discharge.

The narrowly-defined contracted discharge being a discharge that mainly has a form consisting of one linear discharge path extending from a vicinity of an inner surface portion of the lamp bulb (Yt) facing a portion of the lamp bulb (Yt) which one of the external electrodes (Ye1, Ye2) is close to or in contact with, to a vicinity of the inner surface portion of the lamp bulb (Yt) facing a portion of the lamp bulb (Yt) which the other of the external electrodes (Ye1, Ye2) is close to or in contact with.

In the excimer lamp lighting method according to a fifth aspect of the present invention, a ratio of a power value causing the narrowly-defined contracted discharge to a lamp input power value during normal operation is 105% to 120%.

Effect of the Invention

It is possible to provide the excimer lamp light source device that achieves low cost and avoids the occurrence of narrowly-defined contracted discharge by adopting the lamp bulb having a simple structure in which the discharge current flows in the tube axis direction and without having the internal electrode.

MODE FOR CARRYING OUT THE INVENTION

Figure 1:
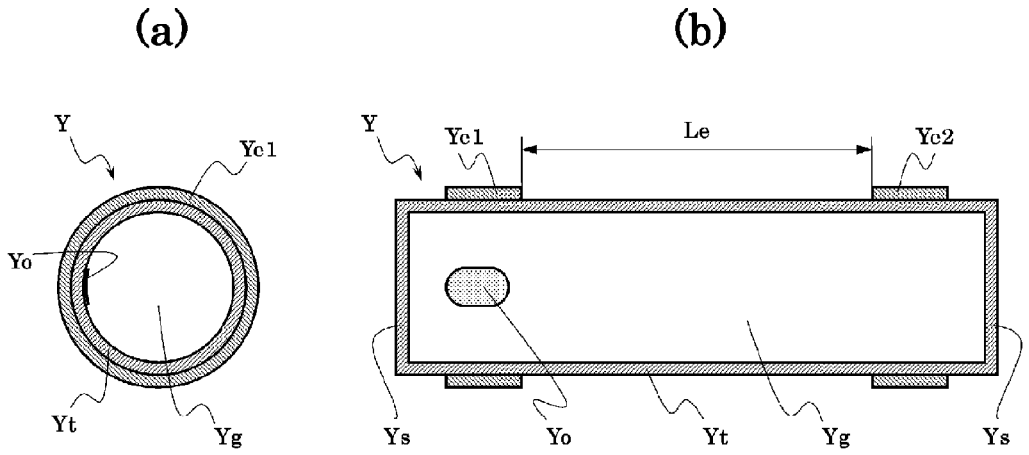
FIG. 1 shows a schematic diagram showing a part of an excimer lamp light source device of the present invention in a simplified manner.

A configuration of an excimer lamp (Y) is described with reference to FIG. 1, which is a schematic diagram showing a part of an excimer lamp light source device of the present invention in a simplified manner.

The excimer lamp (Y) in this drawing is illustrated assuming that a lamp bulb (Yt) is created based on a cylindrical tubular body; (a) in the drawing shows a cross section when the axis of the lamp bulb (Yt) is perpendicular to the paper surface, and (b) in the drawing shows a cross section in the case of the axis of the lamp bulb (Yt) lying within the paper surface.

However, the present invention is not limited to the former having a circular cross-sectional shape.

The lamp bulb (Yt) of the excimer lamp (Y) is configured such that both ends of the tubular body are closed by hermetically sealed part (Ys) so as to enclose a discharge space (Yg), and the discharge space (Yg) is filled with a discharge gas that produces xenon excimer molecules.

Although exemplified as having a planar shape perpendicular to the axis, the hermetically sealed part (Ys) may have a hemispherical shape that bulges outward.

A pair of external electrodes (Ye1, Ye2) are provided on the outer surface of the lamp bulb (Yt) separated from each other in the axial direction.

In this drawing, the case in which a metal plate is wound in a ring shape to form each of the external electrodes (Ye1, Ye2) is exemplified, but the external electrode may be constituted by winding a metal wire once or more, applying, firing, and solidifying a metal paste such as silver paste, or forming a metal vapor deposition film.

The external electrodes (Ye1, Ye2) are not limited to those having a closed figure such as a circle in a cross section perpendicular to the axis as shown in (a) of this drawing, but may have a C shape, for example.

Further, one or both of the external electrodes (Ye1, Ye2) may cover a part or all of the outer surface of the hermetically sealed part (Ys).

Further, the excimer lamp light source device of the present invention includes an inverter (Ui) that generates the high-voltage AC as shown in FIGS. 9, 10, 11, 12, and 13 described later. When a secondary winding (Ls) of a transformer (Tf) of the inverter (Ui) is connected to the external electrodes (Ye1, Ye2), discharge is induced in the discharge space (Yg) of the lamp bulb (Yt), a discharge current is passed in the tube axis direction of the lamp bulb (Yt), and UV light can be generated in the discharge space (Yg).

Note that, in FIG. 1, electrical connection members such as lead wires, which may be provided on the external electrodes (Ye1, Ye2) for connecting the inverter (Ui), are not shown.

An easily dischargeable substance layer (Yo) that facilitates discharge is formed on at least a part of the surface in contact with the discharge space (Yg).

Note that as an easily dischargeable substance (or easily electron-releasing substance), as described in JP-B2-3149780, conductive substances such as carbon described above, metal, tin oxide, and indium oxide can be used.

Further, as described in JP-A-09-180685 and JP-A-11-354079, usable are substances having a work function smaller than the work function of the tubular body constituting the lamp bulb, such as metal compounds selected from the group consisting of magnesium oxide (MgO), lanthanum oxide (La2O3), cerium oxide (CeO2), yttrium oxide (Y2O3), zirconium oxide (ZrO2), and lanthanum boride (LaB6).

FIG. 1 illustrates the lamp which has the easily dischargeable substance layer (Yo) being formed on a part of the inner surface of the portion of the lamp bulb (Yt) where the external electrode (Ye1) is in contact with the outer surface of the lamp bulb (Yt).

Figure 2:
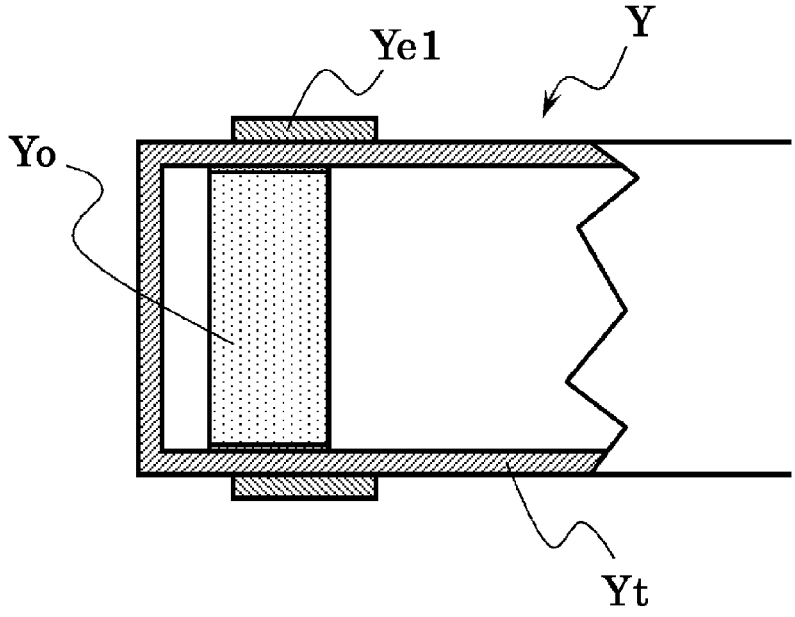
FIG. 2 shows a schematic diagram showing a part of the excimer lamp light source device of the present invention in a simplified manner.
Figure 2:
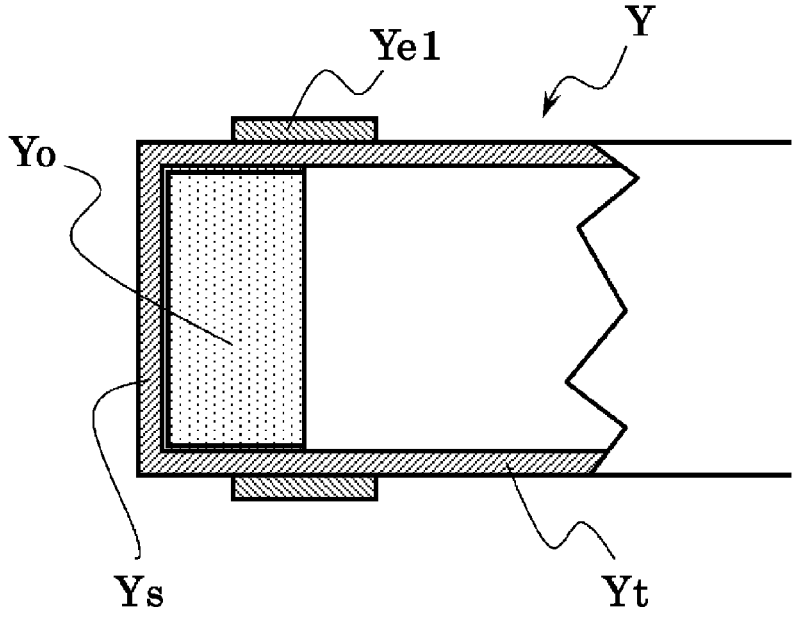

Similarly, as illustrated in (a) of FIG. 2 showing a schematic diagram showing a part of the excimer lamp light source device of the present invention in a simplified manner, the easily dischargeable substance layer (Yo) may be formed on the inner surface of the lamp bulb (Yt) so as to correspond to 360 degrees around the axis. In this case, the easily dischargeable substance layer (Yo) may be formed over a portion of the inner surface of the lamp bulb (Yt) whose outer surface is not in contact with the external electrode (Ye1).

As shown in (b) of FIG. 2, the easily dischargeable substance layer (Yo) may be formed up to the inner surface side of the hermetically sealed part (Ys).

Further, in FIGS. 1 and 2, the easily dischargeable substance layer (Yo) is formed on the side where the external electrode (Ye1) is located, but the easily dischargeable substance layer (Yo) may be formed on the side where the external electrode (Ye2) is located.

Figure 14:
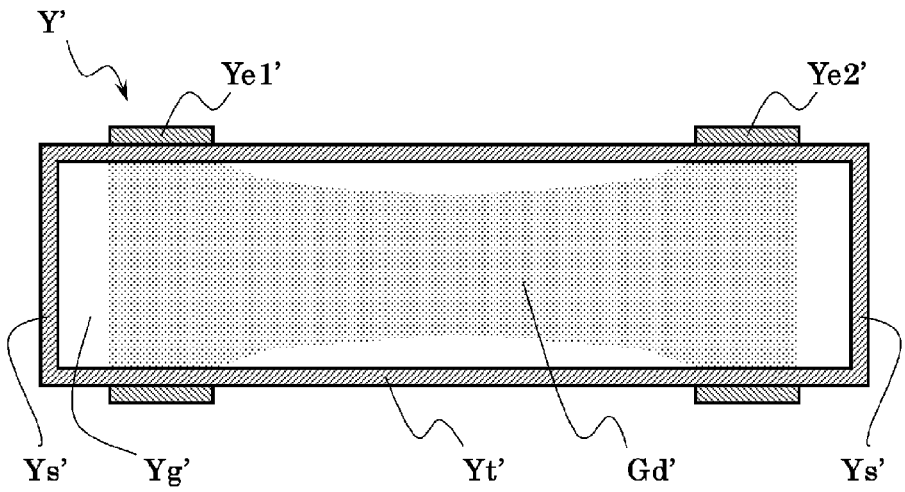
FIG. 14 shows a schematic diagram of a concept related to the technique of the excimer lamp light source device of the present invention.
Figure 14:
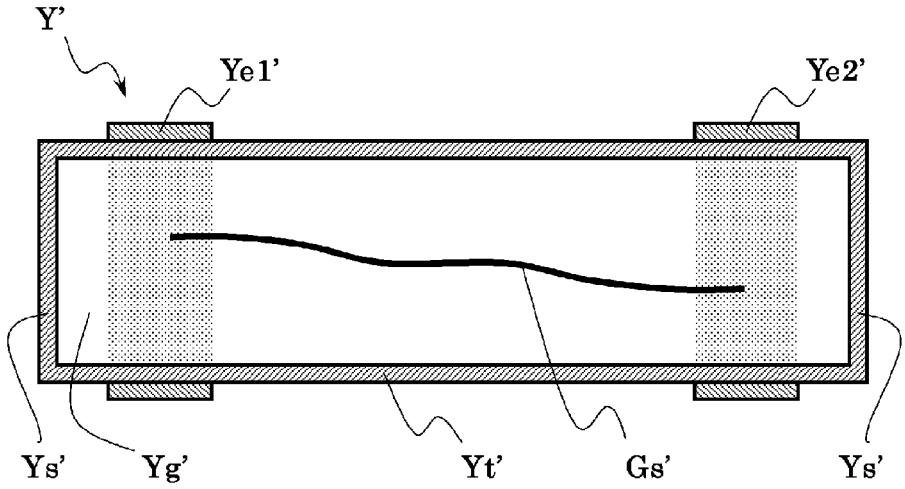

Previously, the lighting experiment regarding the preliminary test lamp has been described with reference to FIG. 14. The results of the further lighting experiment are described below.

The specifications and experimental conditions of the excimer lamp (Y) used in the experiment are as follows.

[Experimental Conditions 1]

Lamp bulb: synthetic quartz tube, outer diameter 10 mm, thickness 0.5 mm, carbon coating Inter-electrode distance (Le): 20 mm Discharge gas, pressure: Ne/Xe=70%/30%, 12 kPa (total pressure)

Frequency: 16 to 45 kHz

PP lamp voltage: 3.3, 3.9, 4.5 kV

One-cycle energy: 12, 15, 18 μJ

Inverter: flyback mode

The "carbon coating" described here means that a carbon paste film forming region is provided as the easily dischargeable substance layer (Yo) having a shape as shown in FIG. 1.

Note that the PP lamp voltage described in the above conditions refers to the peak-to-peak value of the lamp applied voltage, and this abbreviation is used hereafter.

The inverter (Ui) for lighting the lamp of the above-described mode described later was used. The trial experiment of the lamp lighting start was carried out, while keeping the pulse waveform for a part related to discharge in the lamp applied voltage, that is, the PP lamp voltage unchanged, and while changing an input power P to the lamp by changing the operating frequency of the inverter, that is, the pulse generation frequency. Then, a probability Ψ(p) that the diffused discharge was generated in a single start of the lighting was measured for the above three types of PP lamp voltages.

However, the inverter (Ui) has a simple structure that does not particularly perform so-called soft start control such as gradually increasing the PP lamp voltage at the initial stage of lighting, and therefore, the intended PP lamp voltage is achieved in a short time at the initial stage of lighting.

Note that keeping the PP lamp voltage unchanged means keeping the energy input to the lamp unchanged by one pulse waveform, but the one-cycle energy described in the above conditions indicates the energy input to the lamp by one pulse waveform corresponding to each of the above three types of PP lamp voltages.

The one-cycle energy under the above-described experimental conditions was measured under the specified frequency of 30 KHz, which is the frequency at which the diffused discharge is generated in all of the PP lamp voltages with respect to the above-described discharge gas and pressure, by the VQ Lissajous method (see Ozonizer Handbook, Corona Publishing Co., Ltd. (1960), p. 232, or Technical report of the Institute of Electrical Engineers of Japan, No. 830 (2001), p. 71).

Then, the lamp input power can be calculated by multiplying the value of this one-cycle energy by the actual value of the frequency at the time of lighting.

Figure 3:
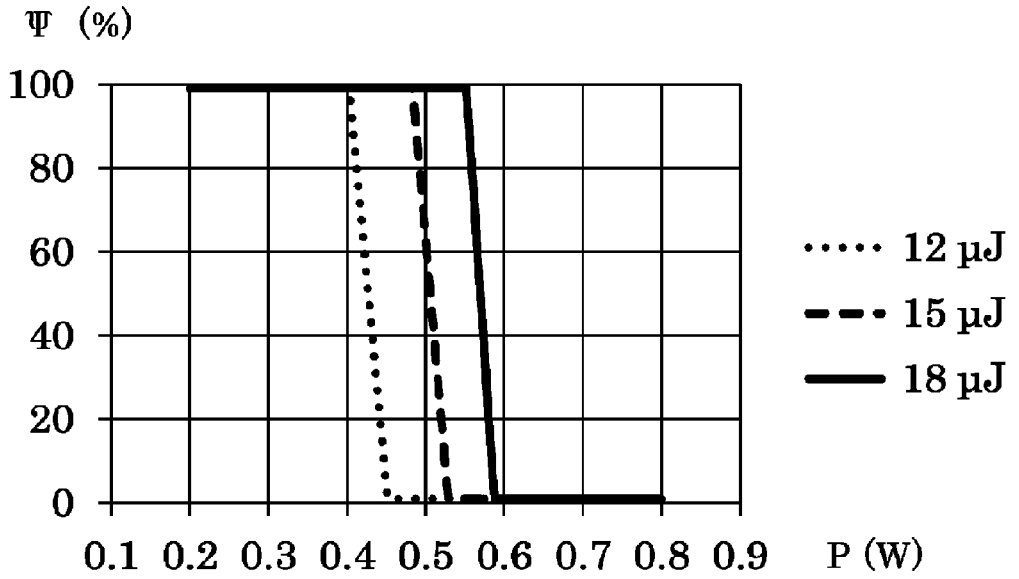
FIG. 3 shows experimental data related to the excimer lamp light source device of the present invention.

The results of the experiment are shown in FIG. 3, which represents the experimental data related to the excimer lamp light source device of the present invention, with the lamp input power P on the horizontal axis and the generation probability Ψ(p) of diffused discharge on the vertical axis.

From the drawing, it can be immediately pointed out that the higher the lamp input power, the lower the generation probability of diffused discharge.

It should be noted here that the lamp input power P on the horizontal axis is expressed by a value calculated by multiplying the value of the one-cycle energy at the time of diffused discharge at the specified frequency of 30 kHz by the value of the actual frequency at the time of lighting.

Therefore, the lamp input power obtained by this calculation is equal to the power actually input to the lamp when the diffused discharge is generated under the lighting conditions, but does not necessarily become equal to the power actually input to the lamp when the narrowly-defined contracted discharge is generated.

In fact, in the one following condition in the above-described experimental conditions 1, which is Frequency: 33 kHz PP lamp voltage: 3.9 kV either diffused discharge or narrowly-defined contracted discharge is generated stochastically. The measurement results of the lamp input power during diffused discharge and narrowly-defined contracted discharge measured by the VQ Lissajous method are as follows.

Lamp input power: 0.47 W during diffused discharge, 0.34 W during narrowly-defined contracted discharge That is, even if the inverter performs exactly the same operation, when the narrowly-defined contracted discharge is generated, the actual lamp input power becomes smaller than that in the state in which the diffused discharge is generated.

Additionally, it has been mentioned earlier that the intensity of the generated UV light is far below the expected practical intensity in the state of the narrowly-defined contracted discharge. The main reason for this is not because of the decrease in the input power to the lamp, but because of the significant decrease in the UV emission efficiency with respect to the input power to the lamp.

In addition, the following experiment was carried out to deepen the understanding of the relationship between the diffused discharge and the narrowly-defined contracted discharge.

It is known that when the power is gradually increased by gradually increasing the frequency from the state of the diffused discharge being generated while keeping the PP lamp voltage constant, the discharge becomes the narrowly-defined contracted discharge at a certain frequency or more, so the frequency at which the diffused discharge transited to the narrowly-defined contracted discharge, that is, a narrowly-defined contracted discharge transition frequency, was recorded. On the other hand, it is known that when the power is gradually reduced by gradually lowering the frequency from the state of the narrowly-defined contracted discharge being generated, the discharge becomes the diffused discharge at a certain frequency or less, so the frequency at which the narrowly-defined contracted discharge transited to the diffused discharge, that is, a diffused discharge recovery frequency, was recorded. Then, comparing the recorded frequencies with each other, it was found that the diffused discharge recovery frequency was significantly lower than the narrowly-defined contracted discharge transition frequency.

That is, it was found that the transition between the diffused discharge and the narrowly-defined contracted discharge is accompanied by hysteresis.

That is, in FIG. 3 obtained by the experiment, even if the narrowly-defined contracted discharge appears to be generated from the initial stage of lighting, the diffused discharge has been generated for a short time immediately after the start of discharge. During that period, the power input to the lamp reaches the power value at which the power immediately before the generation of the narrowly-defined contracted discharge causes the narrowly-defined contracted discharge, or specifically, the power value that causes the transition from the diffused discharge to the narrowly-defined contracted discharge, that is, the narrowly-defined contracted discharge generation threshold power value Pt. Therefore, it can be understood that, as a result, the narrowly-defined contracted discharge is generated.

Therefore, by interpreting that the lamp input power P on the horizontal axis in FIG. 3 represents the lamp input power during the diffused discharge that is broadly defined, including the power immediately before the generation of the narrowly-defined contracted discharge, it can be said that the graph of FIG. 3 is correct, including the case in which the power in the steady discharge state falls into the narrowly-defined contracted discharge in a small scale.

It has been stated before that even in the case of the narrowly-defined contracted discharge being generated, the diffused discharge is generated for a short time immediately after the start of discharge, and thereafter, the narrowly-defined contracted discharge having a small lamp input power is generated. Therefore, it may be pointed out that if the diffused discharge is actually generated for a short time immediately after the start of discharge, this should be confirmed by observing the waveforms of the lamp voltage and the lamp current using an oscilloscope. However, although actual trials were performed, this could not be confirmed.

This is because, in the observation in the case of the same lighting condition and in which any one of the diffused discharge and the narrowly-defined contracted discharge is generated stochastically, the waveforms of the diffused discharge and the narrowly-defined contracted discharge cannot be distinguished from each other by the observation under the condition in which the envelope waveforms of the lamp voltage and the lamp current are made visible, because there is hardly any difference seen in the peak-to-peak values of the lamp voltage and the lamp current between during diffused discharge and narrowly-defined contracted discharge.

It is considered that this can be confirmed by performing observations in which the phase difference information of the lamp voltage waveform and the lamp current waveform is displayed as a waveform in the same manner, but this has not been performed.

In addition, it can be pointed out from the drawing that the higher the one-cycle energy, that is, the PP lamp voltage, the easier it is to increase the generation probability of the diffused discharge.

As described above, WO 2008/038527 and JP-A-2006-338897 of the prior art documents describe that when the applied voltage is increased, a state becomes the contracted discharge in the vicinity of the internal electrode. However, the results of this experiment show the opposite tendency, and because the lamp of this experiment does not have an internal electrode in the first place, it can be seen that the contracted discharge described in these documents and the narrowly-defined contracted discharge of interest are different physical phenomena.

Here, an additional explanation regarding this drawing is made.

Focusing on one one-cycle energy, the generation probability of diffused discharge is illustrated so as to linearly change from 100% to 0% as the lamp input power changes from low to high conditions. This does not mean that the exact state of change is actually linear, but it should be understood that there is an upper limit of the lamp input power that experimentally makes the generation probability of diffused discharge 100%, and when the lamp input power is increased higher than the upper limit, the generation probability of diffused discharge will decrease and eventually reach 0%.

Actually, in this experiment, it was focused on determining the lamp input power value at which the generation probability of diffused discharge becomes 100% and the lamp input power value at which the generation probability thereof becomes 0%.

At the lamp input power value in the middle of those values, lighting was tried about five times, but even when the lamp lighting start was tried with the same value, it was completely stochastic whether or not the diffused discharge was generated.

The reason why the state of change from 100% to 0% was not measured accurately is that it is necessary to try a very large number of the lamp lighting start for accurate measurement, and even if the accurate measurement can be obtained, there is no practical benefit.

In the case of an external electrode type discharge lamp such as the excimer lamp (Y) of the excimer lamp light source device of the present invention, the lamp input power depends on in a positively correlated manner to the difference between the maximum voltage and the minimum voltage in the voltage waveform in one cycle, that is, to the PP lamp voltage and to the frequency almost independently. Specifically, regarding the frequency, the lamp input power is proportional to the frequency.

As described above, FIG. 3 is the graph focusing on a certain PP lamp voltage and showing the influence on the generation probability Ψ(p) of the diffused discharge when the lamp input power P is changed by changing the frequency while the PP lamp voltage is kept unchanged.

On the contrary, when the focus is made on a certain frequency, the influence on the generation probability Ψ(p) of the diffused discharge when the lamp input power P is changed by changing the PP lamp voltage while the frequency is kept constant cannot be interpreted from this drawing.

Figure 4:
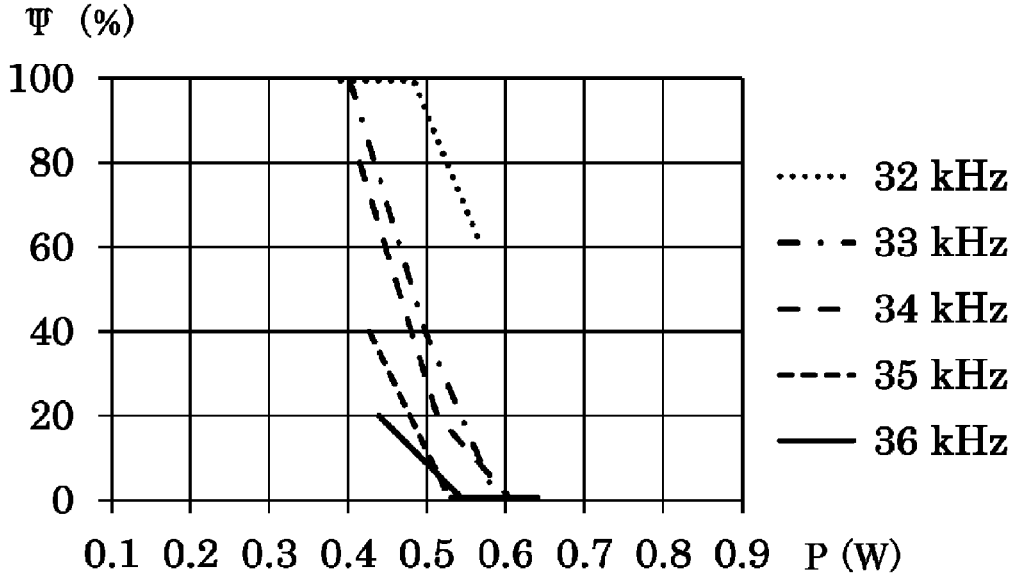
FIG. 4 shows experimental data related to the excimer lamp light source device of the present invention.

Therefore, a graph actually illustrating the above case is shown in FIG. 4, which represents experimental data related to the excimer lamp light source device of the present invention.

Original data used for creating the graphs are the same in FIG. 3 and FIG. 4, but in creating FIG. 4, data of frequency at which generation probability of diffused discharge is 100% or 0% is excluded regardless of the lamp input power.

From FIG. 4, it can be pointed out that the higher the lamp input power, the lower the generation probability of diffused discharge.

As mentioned above, in order to accurately measure the state of change from 100% to 0%, it is necessary to try a very large number of lamp lighting start, but in reality, only a few trials were carried out. Therefore, it should be understood from this drawing that it was confirmed that the generation probability Ψ(p) of diffused discharge decreases toward the right as the lamp input power P increases.

The results of the further lighting experiment are described below.

The specifications and experimental conditions of the excimer lamp (Y) used in the experiment are as follows.

[Experimental Conditions 2]

Lamp bulb: synthetic quartz tube, outer diameter 10 mm, thickness 0.5 mm, carbon coating Inter-electrode distance (Le): 20 mm Discharge gas: Ne/Xe=70%/30%

Gas pressure: 8.0, 11, 12, 13 kPa (total pressure)

Frequency: 20 to 45 kHz

PP lamp voltage: 3.9 kV

Inverter: flyback mode

The inverter (Ui) for lighting the lamp of the above-described mode described later was used as before. The trial experiment of starting the lamp lighting was carried out, while keeping the pulse waveform for a part related to discharge in the lamp applied voltage, that is, the PP lamp voltage unchanged, and while changing an input power P to the lamp by changing the operating frequency of the inverter, that is, the pulse generation frequency. Then, a probability Ψ(p) that the diffused discharge was generated in a single start of the lighting was measured for the above four types of gas pressures.

Figure 5:
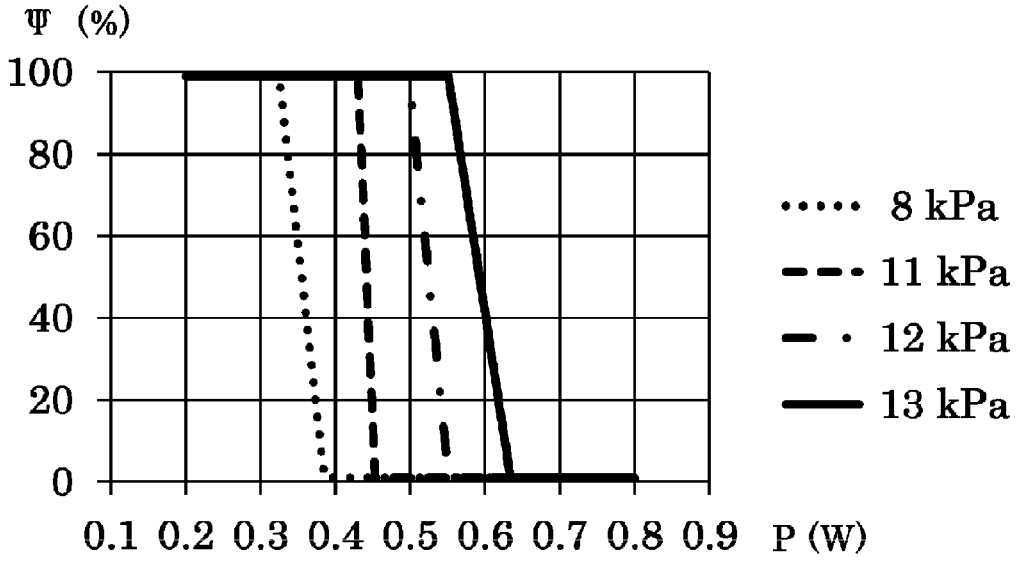
FIG. 5 shows experimental data related to the excimer lamp light source device of the present invention.

The results of the experiment are shown in FIG. 5, which represents the experimental data related to the excimer lamp light source device of the present invention.

Similar to the previous drawing, in this drawing, the lamp input power P on the horizontal axis is expressed by a value calculated by multiplying the value of the one-cycle energy at the time of diffused discharge at the specified frequency by the value of the actual frequency at the time of lighting.

From the drawing, it can be immediately pointed out that, similarly to the above, the higher the lamp input power, the lower the generation probability of diffused discharge, but in addition, it can also be pointed out that the higher the gas pressure, the higher the generation probability of diffused discharge.

As described above, JP-A-2000-223079 of the prior art document describes that the discharge contracts when the gas pressure of xenon gas is increased. However, the results of this experiment show the opposite tendency; therefore, it can be seen that the contracted discharge described in this document and the narrowly-defined contracted discharge of interest are different physical phenomena.

The results of the further lighting experiment are described below.

The specifications and experimental conditions of the excimer lamp (Y) used in the experiment are as follows.

[Experimental Conditions 3]

Lamp bulb: synthetic quartz tube, outer diameter 10 mm, thickness 0.5 mm, carbon coating Inter-electrode distance (Le): 20 mm Discharge gas, pressure: Xe 100%, 3.3, 6.7 kPa Frequency: 16 to 53 kHz PP lamp voltage: 3.3, 3.9, 4.5 kV Inverter: flyback mode The inverter (Ui) for lighting the lamp of the above-described mode described later was used as before. The trial experiment of starting the lamp lighting was carried out, while keeping the pulse waveform for a part related to discharge in the lamp applied voltage, that is, the PP lamp voltage unchanged, and while changing an input power P to the lamp by changing the operating frequency of the inverter, that is, the pulse generation frequency. Then, a probability Ψ(p) that the diffused discharge was generated in a single start of the lighting was measured for the above three types of PP lamp voltages and two types of gas pressures.

In the experiments described so far, a mixed gas in which neon as a buffer gas is added to xenon was used as the discharge gas, but in this experiment, a lamp using only xenon as the discharge gas was investigated.

The results of the experiment showed that the generation probability of diffused discharge tends to decrease as the lamp input power increases, similar to those in FIGS. 3 and 5 (however, the drawing is omitted).

The results of the further lighting experiment are described below.

The specifications and experimental conditions of the excimer lamp (Y) used in the experiment are as follows.

[Experimental Conditions 4]

Lamp bulb: synthetic quartz tube, outer diameter 10 mm, thickness 0.5 mm, carbon coating Inter-electrode distance (Le): 20 mm Discharge gas: Ne/Xe=70%/30%

Gas pressure: 8.0, 12 kPa (total pressure)

Frequency: 10 to 65 kHz

PP lamp voltage: 3.9 kV

Inverter: push-pull mode

The inverter (Ui) for lighting the lamp of the above-described mode described later was used, which is different to those used in the former experiments. The trial experiment of starting the lamp lighting was carried out, while keeping the pulse waveform for a part related to discharge in the lamp applied voltage, that is, the PP lamp voltage unchanged, and while changing an input power P to the lamp by changing the operating frequency of the inverter, that is, the pulse generation frequency. Then, a probability Ψ(p) that the diffused discharge was generated in a single start of the lighting was measured for the above two types of gas pressures.

The results of the experiment showed that the generation probability of diffused discharge tends to decrease as the lamp input power increases, similar to those in FIG. 5 (however, the drawing is omitted).

From the experimental results described above, in the excimer lamp (Y) of the type in which the lamp bulb (Yt) has both ends of the tubular body being hermetically sealed and has the easily dischargeable substance layer (Yo) formed on the surface in contact with the discharge space (Yg), and which does not have the internal electrode, passes the discharge current in the tube axis direction, and has the pair of external electrodes (Ye1, Ye2), it was found that there is a tendency that the higher the lamp input power, the lower the generation probability of diffused discharge, and the above-described narrowly-defined contracted discharge is generated easily.

The changes in each parameter of the experimental conditions such as the PP lamp voltage, the inverter frequency, the gas pressure, the gas composition (mixing ratio of xenon as the main discharge gas and buffer gas), and the inverter circuit type (drive waveform), also have the influence to some extent on the relationship between the lamp input power and the generation probability of the diffused discharge, but it was confirmed that the dominant control factor for the generation probability of diffused discharge is indeed the lamp input power.

As described above, in the state of the narrowly-defined contracted discharge being generated, because the UV emission efficiency with respect to the input power to the lamp is extremely low, by making the power supplied to the lamp lower than the power at which the narrowly-defined contracted discharge is generated, the generation of the narrowly-defined contracted discharge can be avoided to prevent the discharge state from having low UV emission efficiency.

In the various lighting experiments described so far, the inter-electrode distance (Le) was all 20 mm.

In the following, an experiment in which the inter-electrode distance (Le) was changed under a plurality of discharge gas conditions is described.

The specifications and experimental conditions of the excimer lamp (Y) used in the experiment are as follows.

[Experimental Conditions 5]

Lamp bulb: synthetic quartz tube, outer diameter 10 mm, thickness 0.5 mm, platinum paste Inter-electrode distance (Le): 10, 15, 20, 25, 30, 35, 40 mm Discharge gas: (1) Ne/Xe=70%/30%, total pressure: 9.1 kPa Discharge gas: (2) Ne/Xe=70%/30%, total pressure: 12 kPa Discharge gas: (3) Ne/Xe=70%/30%, total pressure: 16 kPa Discharge gas: (4) Ne/Xe=95%/5%, total pressure: 40 kPa Discharge gas: (5) Ne/Xe=95%/5%, total pressure: 53 kPa PP lamp voltage: 3.9 kV Inverter: flyback mode The lamp bulb (Yt) of this experiment has a form of FIG. 1 which is similar to that of the above-described experimental conditions 1 to 4, but the inter-electrode distance (Le) was changed by fixing the external electrode (Ye1) on the side of the easily dischargeable substance layer (Yo) formed by applying platinum paste, and by sliding the external electrode (Ye2) on the opposite side along the cylindrical surface of the lamp bulb (Yt).

The inverter (Ui) for lighting the lamp of the above-described mode described later was used. Then, while the pulse waveform for a part related to discharge in the lamp applied voltage, that is, the PP lamp voltage kept unchanged, the experiment of gradually increasing the operating frequency of the inverter, that is, the pulse generation frequency from the low condition was repeated until the narrowly-defined contracted discharge was generated. Then, a power value, that is, a narrowly-defined contracted discharge generation threshold power value Pt at that time was measured for the above five types of discharge gas conditions (1), (2), (3), (4) and (5).

Figure 6:
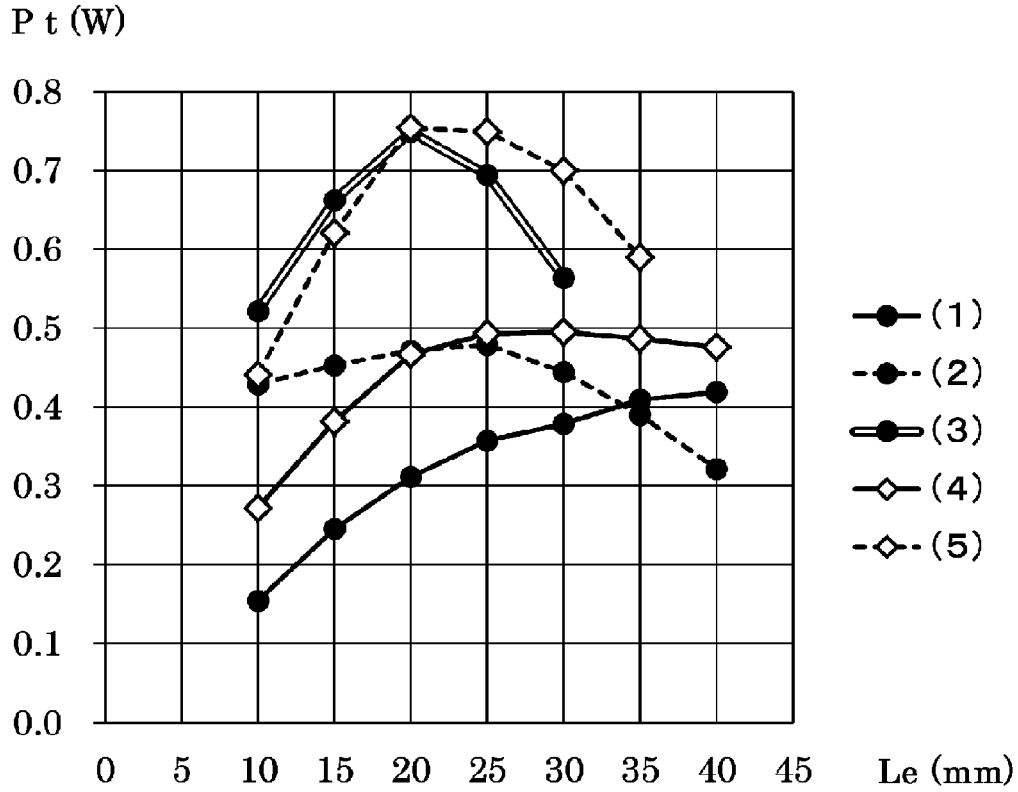
FIG. 6 shows experimental data related to the excimer lamp light source device of the present invention.

The results of the experiment are shown in FIG. 6, which represent the experimental data related to the excimer lamp light source device of the present invention.

Figure 7:
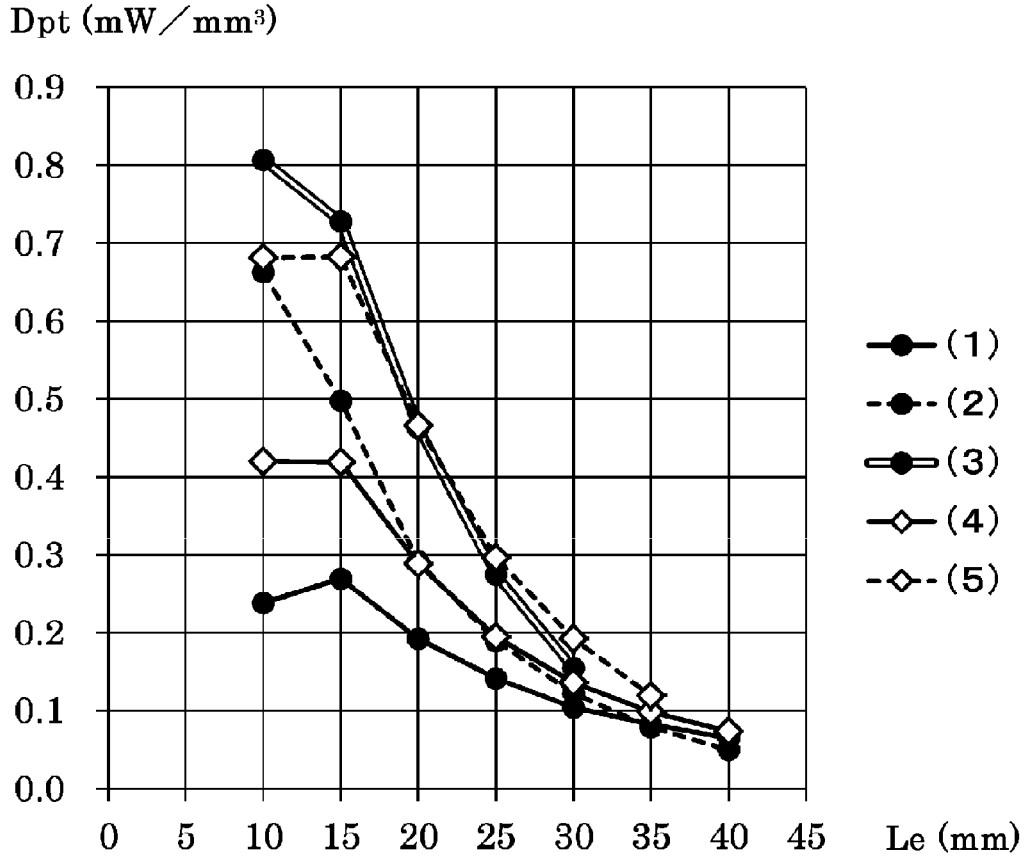
FIG. 7 shows experimental data related to the excimer lamp light source device of the present invention.

In addition, the results obtained by dividing the narrowly-defined contracted discharge generation threshold power value Pt on the vertical axis of the graph of this experimental result by the volume of the discharge space, and converting the value to a narrowly-defined contracted discharge generation threshold power density value Dpt as the power value per unit volume, are shown in FIG. 7 showing experimental data related to the excimer lamp light source device of the present invention.

The volume of the discharge space indicates the value calculated by multiplying the sum of the inter-electrode distance (Le), the width of the external electrode (Ye1), and the width of the external electrode (Ye2), by the cross-sectional area of the cross section perpendicular to the axis of the internal space of the lamp bulb (Yt).

Examining FIG. 7 first, a flat portion can be seen at the left end of the graph line for each discharge gas condition. Appearance of this flat portion is understandable from the usual way of thinking that the discharge phenomenon will not possibly change if the power value per unit volume is the same.

However, the narrowly-defined contracted discharge generation threshold power density value Dpt decreases sharply as the inter-electrode distance increases.

This is because in the case of the excimer lamp of the type in which the discharge current is passed in the tube axis direction, when the degree of "elongation of the discharge space" of viewing the discharge current direction (tube axis direction) in the length direction exceeds a certain limit value, the above idea that the discharge phenomenon will not possibly change if the power value per unit volume is the same breaks down, and it becomes extremely easy to fall into a state of the narrowly-defined contracted discharge.

On the other hand, in FIG. 6, looking from the shortest distance to the longer distance regarding the inter-electrode distance, under many discharge gas conditions, the narrowly-defined contracted discharge generation threshold power value Pt increases toward the right and eventually reaches the maximum, and thereafter, the value decreases toward the right.

Although there are some discharge gas conditions that have not reached the maximum due to the measured range, it is clear from FIG. 7 that if the inter-electrode distance is further increased, the narrowly-defined contracted discharge generation threshold power value Pt will decrease toward the right.

However, at present, it has not been possible to quantitatively predict a location where the value becomes the maximum in the inter-electrode distance by how the shapes and dimensions of the lamp bulb and the discharge gas conditions are set.

Therefore, regarding a region of the inter-electrode distance equal to or less than the value of the inter-electrode distance (Le) that gives the maximum value when the inter-electrode distance (Le) is changed with respect to the minimum value of the power that causes the narrowly-defined contracted discharge, that is, a region where the graph line is horizontal or rising toward the right, the region can be said to be a particularly advantageous region under the specified conditions for the cross-sectional area, the gas composition, and the gas pressure of the lamp bulb (Yt), and from the demand of inputting as much electric power as possible.

It should be noted that the region of the inter-electrode distance equal to or less than the value of the inter-electrode distance (Le) that gives the maximum value when the inter-electrode distance (Le) is changed with respect to the minimum value of the power that causes the narrowly-defined contracted discharge, means, in a more general expression including the case of not observing the maximum, the region of the inter-electrode distance (Le) where the minimum value of the power that causes the narrowly-defined contracted discharge increases when the inter-electrode distance (Le) is increased, or where the increase saturates.

Here, the reason of including not only the horizontal region near the maximum of the graph line but also the rightward-rising region on the left side of the graph line is because, as described above, it is unclear where the value becomes maximum in the inter-electrode distance. Because the maximum position cannot be strictly controlled, it is expected that the maximum position may move slightly to the right or left due to variations in lamp manufacturing, changes in lamp characteristics after manufacturing, changes in environmental conditions, and so on. Therefore, the above region should be included in the selectable range as a safe region as a measure against the risk of falling into the state of the narrowly-defined contracted discharge even if such movement occurs.

Figure 8:
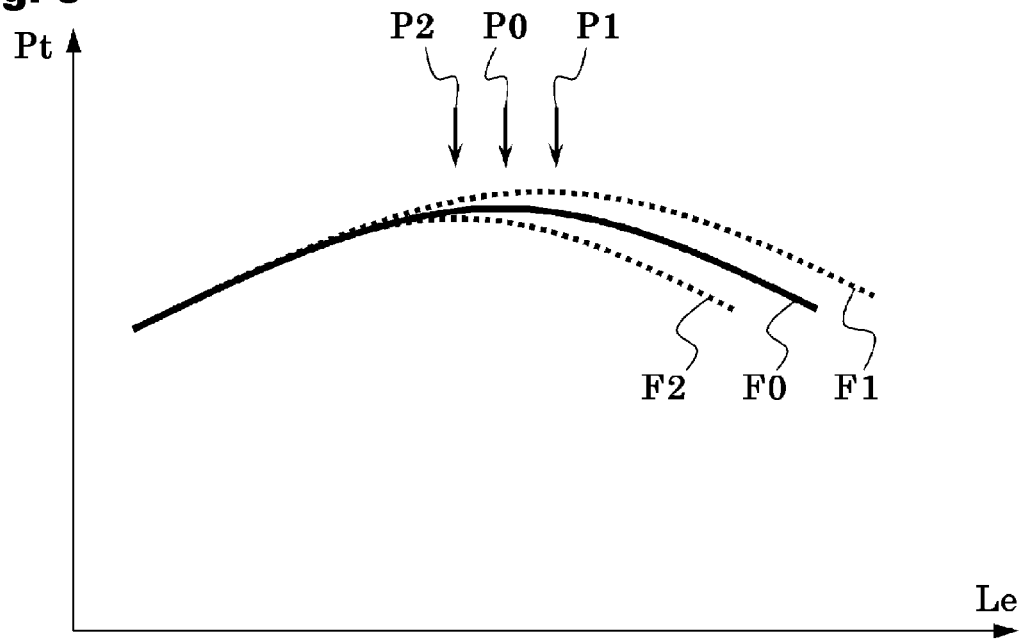
FIG. 8 shows a schematic diagram of a concept related to a technique of the excimer lamp light source device of the present invention.

The reason why the rightward-rising region is safe is described with reference to FIG. 8, which shows a schematic diagram of a concept related to the technique of the excimer lamp light source device of the present invention.

This drawing conceptually expresses the relationship between the inter-electrode distance (Le) and the narrowly-defined contracted discharge generation threshold power value Pt for one of the discharge gas conditions in FIG. 6 as a continuous curve, and the scales of the horizontal and vertical axes are the same as in FIG. 6.

First, it is assumed that the narrowly-defined contracted discharge generation threshold power value expected at the time of design is similar to a threshold power curve (F0) drawn by a solid line, and the maximum position thereof is a central maximum position (P0).

Here, it is assumed that the maximum position moves to the larger side in the inter-electrode distance due to some factor and moves to a maximum position (P1) on the right side.

This happens because the allowance for the elongation of the discharge space has increased, and as a result, the volume of the discharge space at the maximum position (P1) increases, so the narrowly-defined contracted discharge generation threshold power value Pt also increases, and the curve appears as a threshold power curve (F1) drawn by a broken line.

At this time, the state of the threshold power curve (F1) in the region of the inter-electrode distance on the left side of the maximum position (P0) of the original threshold power curve (F0) hardly changes as compared to the state of the threshold power curve (F0).

This is because the region of the inter-electrode distance is within the allowable range for the elongation of the discharge space before and after the change.

Next, it is assumed that the maximum position moves to the smaller side in the inter-electrode distance due to some factor and moves to a maximum position (P2) on the left side.

This happens because the allowance for the elongation of the discharge space has reduced, and as a result, the volume of the discharge space at the maximum position (P2) is reduced, so the narrowly-defined contracted discharge generation threshold power value Pt also reduces, and the curve appears as a threshold power curve (F2) drawn by a broken line.

At this time, the state of the threshold power curve (F2) in the region of the inter-electrode distance on the left side of the moved threshold power curve (F2) excluding the vicinity of the maximum position (P2) hardly changes as compared to the state of the original threshold power curve (F0).

This is because the region of the inter-electrode distance is within the allowable range for the elongation of the discharge space before and after the change.

Therefore, when the set inter-electrode distance is selected from the rightward-lowering region in the original threshold power curve (F0), there is no problem in the maximum position moving to the right. However, when the maximum position moves to the left, because the narrowly-defined contracted discharge generation threshold power value Pt decreases, there is a risk of falling into the state of the narrowly-defined contracted discharge.

On the other hand, when the set inter-electrode distance is selected from the rightward-rising region in the original threshold power curve (F0), the narrowly-defined contracted discharge generation threshold power value (Pt) does not decrease even if the maximum position moves to the right or left, it is safe against the risk of falling into the state of the narrowly-defined contracted discharge.

According to the guideline for selecting the safe region described above, if the lamp under the discharge gas condition described in the above-described experimental condition 5 is manufactured as a product, it can be understood that the inter-electrode distance is preferably selected from a region around 20 mm or less for the discharge gas conditions (3) and (5), a region around 25 mm or less for the discharge gas condition (2), and a region around 30 mm or less for the discharge gas condition (4).

In the case of (1), the maximum position may be outside the range of the inter-electrode distance in which the experiment was conducted, but a region of at least 40 mm or less can be selected.

In FIGS. 3 to 5, as the vertical axis of the graph is represented by the generation probability $\Psi(p)$ of diffused discharge, either the diffused discharge or the narrowly-defined contracted discharge may be stochastically generated near the boundary of the generation condition between the diffused discharge and the narrowly-defined contracted discharge.

In the measurement experiment to obtain FIG. 6, due to the limitation on the amount of measurement work, as described above, the experiment of gradually increasing the pulse generation frequency from the low condition was repeated until the narrowly-defined contracted discharge was generated, and the power value at that time, that is, the narrowly-defined contracted discharge generation threshold power value Pt was measured. Therefore, the stochastic factor is not visible, but there are actually measurement variations.

Therefore, because it is inevitable that the value of the inter-electrode distance (Le) that maximizes the narrowly-defined contracted discharge generation threshold power value Pt is accompanied by uncertainty, the position of the maximum value may not be specified.

In order to avoid this problem, a position of the maximum value may be specified after performing the moving average processing on the actually measured narrowly-defined contracted discharge generation threshold power value Pt to smooth the unevenness of the graph line.

Alternatively, for the measurement values whose difference between the actually measured narrowly-defined contracted discharge generation threshold power value Pt and the maximum value is, for example, 5% or less, or whose difference therebetween is 10% or less, which is a representative value of the change width of the lamp input power P for the generation probability Ψ(p) of the diffused discharge to change from 100% to 0% in FIGS. 3 and 5, the above values may be treated so as to be regarded as the same as the maximum value (included in the horizontal region).

As described in the lighting experiment described above, the narrowly-defined contracted discharge generation threshold power value Pt described above changes depending on the one-cycle energy and gas pressure, which are parameters at the time of the experiment.

Naturally, this power value also changes depending on parameters such as the shape and size of the lamp, the type of buffer gas, and the mixing ratio with xenon.

Therefore, by appropriately setting these parameters, the relationship between the lamp input power that achieves the intended UV light intensity, which is the lamp input power value during normal operation, that is, an operating input power value Pw, and the narrowly-defined contracted discharge generation threshold power value Pt, can be set such that the narrowly-defined contracted discharge generation threshold power value Pt is slightly larger than the operating input power value Pw; that is, for example, the narrowly-defined contracted discharge generation threshold power value Pt becomes 105%, 110%, or 120% of the operating input power value Pw.

By configuring the excimer lamp light source device in this way, if the adjustment of the inverter (Ui) deviates in the direction of causing the lamp input power to be excessive, the discharge state becomes the narrowly-defined contracted discharge. As a result, the intensity of UV light emitted from the excimer lamp (Y) decreases, and the lamp cannot function as the excimer lamp light source device. However, there are advantages that excessive UV light exposure of a human body and excessive generation of ozone are especially avoided and the safety is secured.

Now, various types of inverters (Ui) as examples, usable to configure the excimer lamp light source device of the present invention, are described with reference to FIGS. 9, 10, 11, 12, and 13 which are schematic views showing the excimer lamp light source device of the present invention in a simplified manner.

The inverter (Ui) of the present invention needs to supply the power to the lamp which is lower than the power generated by the narrowly-defined contracted discharge in the excimer lamp (Y), that is, needs to be able to set the lamp input power. As described above, in the case of the external electrode type discharge lamp, the lamp input power depends in a positively correlated manner to the difference between the maximum voltage and the minimum voltage in the voltage waveform in one cycle, that is, to the PP lamp voltage and to the frequency almost independently, and specifically, regarding the frequency, the lamp input power is proportional to the frequency. Therefore, this can be achieved by setting the output voltage of a direct current (DC) power supply (Mx), setting a winding ratio of primary and secondary windings of the transformer (Tf), and setting the operating frequency of the inverter (Ui) by adjusting parameters of a gate signal generation circuit (Uf) described below.

Naturally, even with the types of inverters not listed here, one that can set the lamp input power and can generate an intended discharge in the discharge space of the excimer lamp can be used for the inverter of the excimer lamp light source device of the present invention.

Figure 9:
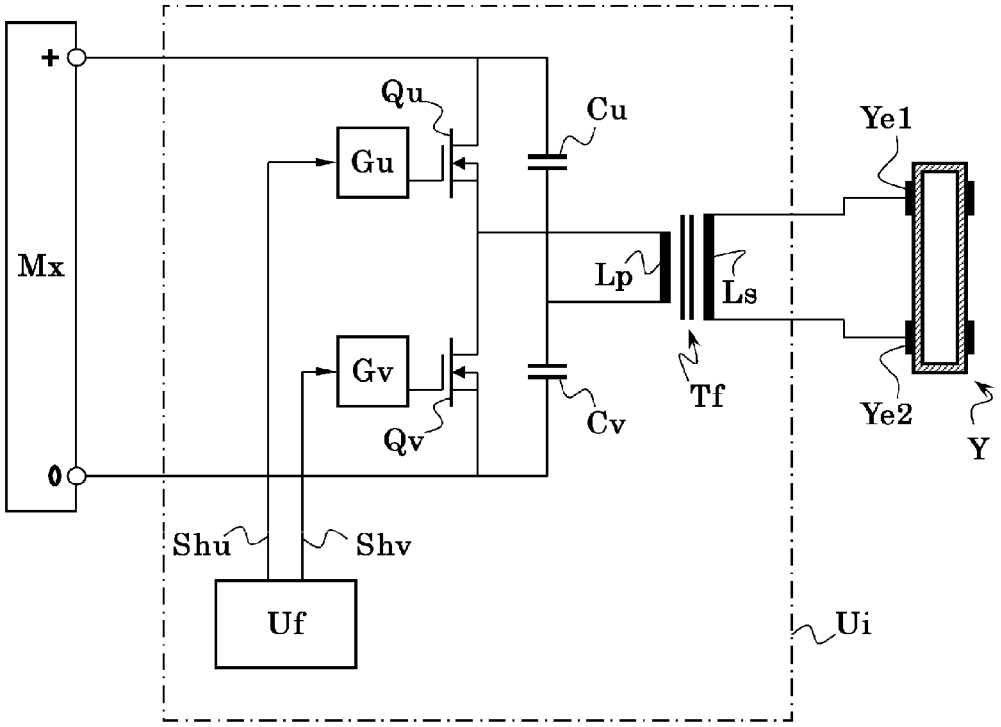
FIG. 9 shows a schematic diagram showing the excimer lamp light source device of the present invention in a simplified manner.

The inverter (Ui) depicted in FIG. 9 is of a type called a half-bridge mode, in which a primary winding (Lp) of the transformer (Tf) is driven alternately by two switch elements (Qu, Qv) such as FETs.

A secondary winding (Ls) of the transformer (Tf) has an appropriate winding ratio to the primary winding (Lp), and to both ends thereof, the external electrodes (Ye1, Ye2) of the excimer lamp (Y) are connected.

The switch elements (Qu, Qv) are connected in series, and capacitors (Cu, Cv) are also connected in series, and the voltage of the DC power supply (Mx) is applied to both ends of the two series-connected elements connected in parallel.

Both ends of the primary winding (Lp) are connected to a connection node of the two switch elements (Qu, Qv) and a connection node of the two capacitors (Cu, Cv), respectively.

The switch elements (Qu, Qv) are controlled via gate drive circuits (Gu, Gv) by alternately active gate signals (Shu, Shy) generated by the gate signal generation circuit (Uf).

The gate signal generation circuit (Uf) generates the gate signals (Shu, Shy) such that each of the switch elements (Qu, Qv) alternately repeats an ON state and an OFF state. However, when the ON state is switched, a period called a dead time in which both of the switch elements (Qu, Qv) are in the OFF state is inserted.

By the configuration and operation of the inverter (Ui) shown in this drawing, the high-voltage AC is applied to the external electrodes (Ye1, Ye2) of the excimer lamp (Y), and the discharge is generated in the discharge space (Yg).

Figure 10:
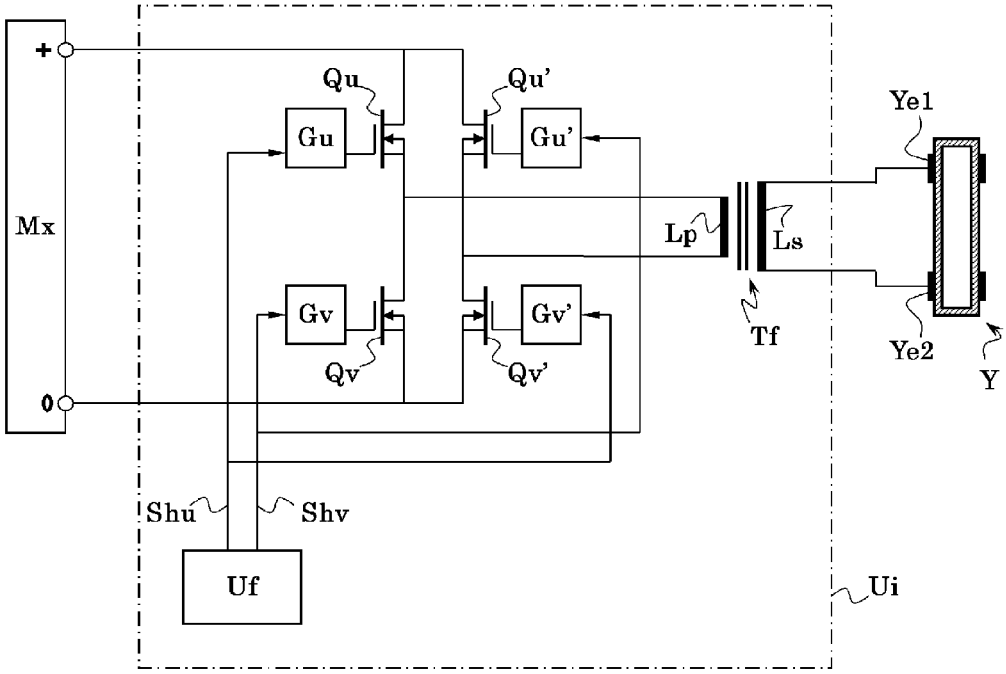
FIG. 10 shows a schematic diagram showing the excimer lamp light source device of the present invention in a simplified manner.

The inverter (Ui) drawn in FIG. 10 is of a type called a full-bridge mode, in which the primary winding (Lp) of the transformer (Tf) is driven by four switch elements (Qu, Qv, Qu', Qv'). These switch elements are controlled via gate drive circuits (Gu, Gv, Gu', Gv') by the gate signals (Shu, Shy) from the gate signal generation circuit (Uf) that operates in the same way as that of the half-bridge mode described above, and when the switch elements (Qu, Qv') are in the ON state, the switch elements (Qv, Qu') are in the OFF state, and when the switch elements (Qv, Qu') are in the ON state, the switch elements (Qu, Qv') operates so as to be in the OFF state.

By the configuration and operation of the inverter (Ui) shown in this drawing, the high-voltage AC is applied to the external electrodes (Ye1, Ye2) of the excimer lamp (Y), and the discharge is generated in the discharge space (Yg).

Figure 11:
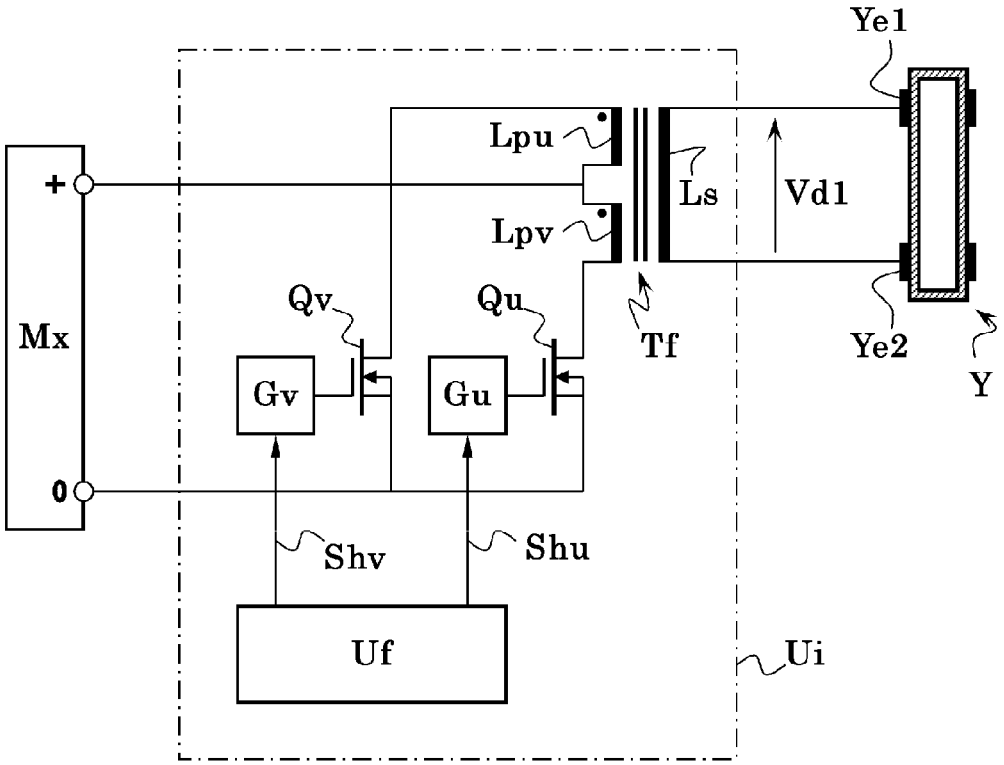
FIG. 11 shows a schematic diagram showing the excimer lamp light source device of the present invention in a simplified manner.

The inverter (Ui) drawn in FIG. 11 is of a type called a push-pull mode, in which two primary windings (Lpu, Lpv) of the transformer (Tf) are alternately driven by the two switch elements (Qu, Qv) controlled via the gate drive circuits (Gu, Gv) by the gate signals (Shu, Shy) from the gate signal generation circuit (Uf) that operates in the same way as that of the half-bridge mode described above.

By the configuration and operation of the inverter (Ui) shown in this drawing, the high-voltage AC is applied to the external electrodes (Ye1, Ye2) of the excimer lamp (Y), and the discharge is generated in the discharge space (Yg).

The voltage waveform applied to the external electrodes (Ye1', Ye2') by the inverters (Ui) of FIGS. 9, 10, and 11 described above becomes a waveform that includes disturbance from a square wave as an ideal concept, the disturbance including overshoot immediately after the polarity inversion, ringing after overshoot, and voltage relaxation in the dead time period before the next polarity inversion with respect to the waveform based on the square wave.

Figure 12:
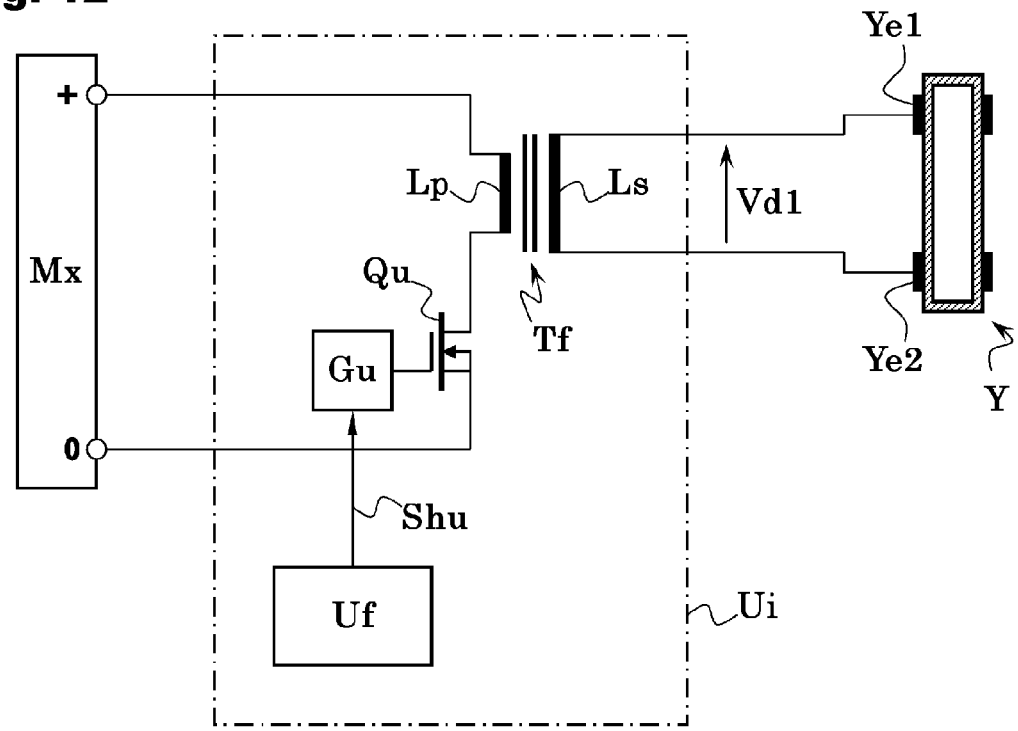
FIG. 12 shows a schematic diagram showing the excimer lamp light source device of the present invention in a simplified manner.

The inverter (Ui) drawn in FIG. 12 is of a type called a flyback mode, in which one primary winding (Lp) of the transformer (Tf) is driven by repeating the ON state and the OFF state of one switch element (Qu) controlled via the gate drive circuit (Gu) by the gate signal (Shu) from the gate signal generation circuit (Uf).

In the period during which the switch element (Qu) is in the ON state, magnetic energy based on the exciting current flowing through the primary winding (Lp) is accumulated in the core of the transformer (Tf), and when the switch element (Qu) is turned to the OFF state, the accumulated magnetic energy is released as electrical energy in the secondary winding (Ls), thereby the high-voltage AC is applied to the external electrodes (Ye1, Ye2) of the excimer lamp (Y) and the discharge is generated in the discharge space (Yg).

The waveform of the high-voltage AC in this case is a single-pulse waveform in which the absolute value of the voltage rises, peaks, and falls immediately after the switch element (Qu) is turned off.

Depending on a duty cycle ratio during the ON state period of the switch element (Qu), ringing following the single-pulse waveform may appear.

Figure 13:
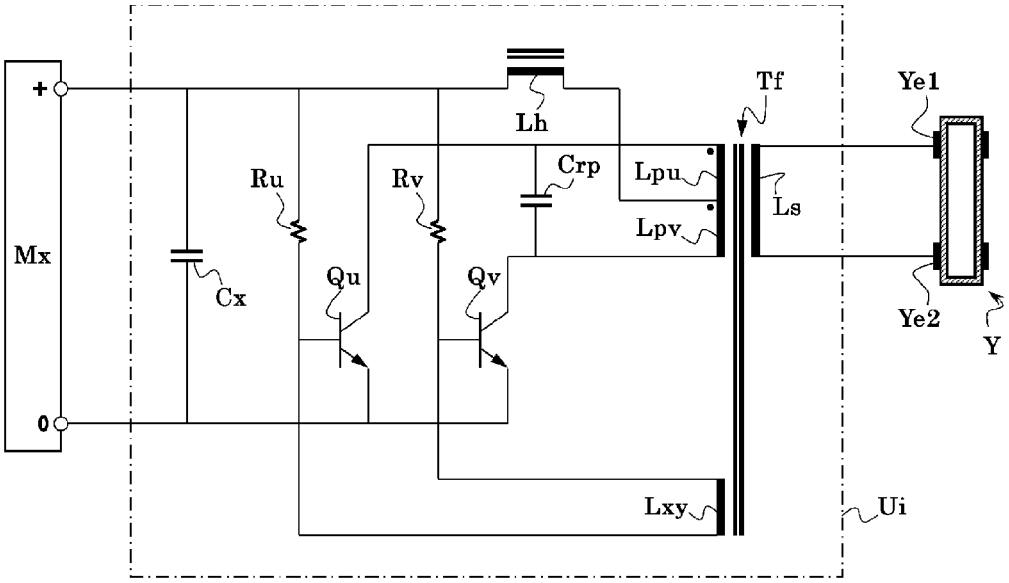
FIG. 13 shows a schematic diagram showing the excimer lamp light source device of the present invention in a simplified manner.

The inverter (Ui) drawn in FIG. 13 is of a type called a collector resonance mode (commonly known as the Royer mode), in which two primary windings (Lpu, Lpv) of the transformer (Tf) connected in series are alternately driven by two switch elements (Qu, Qv) of a bipolar transistor (or FET, etc.).

A resonant circuit is formed by connecting both ends of a resonant capacitor (Crp) to both ends of the series-connected elements of the primary windings (Lpu, Lpv). Further, the output voltage from the positive terminal of the DC power supply (Mx) is supplied to a series connection node of the primary windings (Lpu, Lpv) via a choke coil for stabilizing the supply current, and a smoothing capacitor (Cx) is connected to the DC power supply (Mx) to stabilize the power supply voltage.

A current supply path from the positive terminal of the DC power supply (Mx) described above is formed in the base of the switch elements (Qu, Qv) via base resistors (Ru, Rv), respectively, and both ends of feedback winding (Lxy) provided in the transformer (Tf) are connected to the base of the switch elements (Qu, Qv), respectively.

By configuring the circuit in this way, because self-excited oscillation is performed by the switch elements (Qu, Qv) alternately and complementarily repeating the ON state and the OFF state to alternately invert the current flowing through the primary windings (Lpu, Lpv), the high-voltage AC is applied to the external electrodes (Yet, Ye2) of the excimer lamp (Y), and the discharge is generated in the discharge space (Yg).

Because the resonance circuit is configured as described above, the high-voltage AC waveform in this case has a sinusoidal characteristic.

INDUSTRIAL APPLICABILITY

The present invention can be utilized in the industry that designs and manufactures an excimer lamp light source device that includes an excimer lamp being a suitable light source in constituting a device that generates UV light usable in the fields of, for example, UV ozone cleaning, UV ozone deodorizing, UV surface modification, UV curing, UV sterilization, and others, or converts the wavelength of the generated UV light into other wavelengths, and emits the light, and an inverter that lights the excimer lamp.

DESCRIPTION OF REFERENCE SIGNS

Crp Resonant capacitor
Cu Capacitor
Cv Capacitor
Cx Smoothing capacitor
F0 Threshold power curve
F1 Threshold power curve
F2 Threshold power curve
Gd' Diffused discharge
Gs' Narrowly-defined contracted discharge
Gu Gate drive circuit
Gu' Gate drive circuit
Gv Gate drive circuit
Gv' Gate drive circuit
Le Inter-electrode distance
Lp Primary winding
Lpu Primary winding
Lpv Primary winding
Ls Secondary winding
Lxy Feedback winding
Mx DC power supply
P0 Maximum position
P1 Maximum position
P2 Maximum position
Qu Switch element
Qu' Switch element
Qv Switch element
Qv' Switch element
Ru Base resistor
Rv Base resistor
Shu Gate signal
Shy Gate signal
Tf Transformer
Uf Gate signal generation circuit
Ui Inverter
Y Excimer lamp
Y' Excimer lamp
Ye1 External electrode
Ye1' External electrode
Ye2 External electrode
Ye2' External electrode
Yg Discharge space
Yg' Discharge space
Yo Easily dischargeable substance layer Ys Hermetically sealed part
Ys' Hermetically sealed part
Yt Lamp bulb
Yt' Lamp bulb

The invention claimed is:

1. An excimer lamp light source device comprising:

an excimer lamp (Y) that has a pair of external electrodes (Ye1, Ye2) configured to induce an electric discharge in a discharge space (Yg) of a lamp bulb (Yt) and to cause a discharge current to flow in a tube axis direction of the lamp bulb (Yt), that does not have an internal electrode, and that generates UV light in the discharge space (Yg) by the discharge, the lamp bulb (Yt) enclosing the discharge space (Yg) filled with a discharge gas configured to generate xenon excimer molecules, having a shape in which both ends of a tubular body are hermetically sealed, and having an easily dischargeable substance layer (Yo) that facilitates a discharge formed on at least a part of a surface that is in contact with the discharge space (Yg); and an inverter (Ui) having a transformer (Tf) equipped with a secondary winding (Ls) to which the external electrodes (Ye1, Ye2) are connected in order to apply a high-voltage alternating current to the excimer lamp (Y), wherein the inverter (Ui) supplies power lower than power that causes a narrowly-defined contracted discharge to the excimer lamp (Y) to light the excimer lamp (Y) in a discharge state that is not the narrowly-defined contracted discharge, the narrowly-defined contracted discharge being a discharge that mainly has a form consisting of one linear discharge path extending from a vicinity of an inner surface portion of the lamp bulb (Yt) facing a portion of the lamp bulb (Yt) in which one of the external electrodes (Ye1, Ye2) is close to or in contact with, to a vicinity of the inner surface portion of the lamp bulb (Yt) facing a portion of the lamp bulb (Yt) in which another of the external electrodes (Ye1, Ye2) is close to or in contact with.

2. The excimer lamp light source device according to claim 1, wherein the pair of external electrodes (Ye1, Ye2) have an inter-electrode distance (Le), which is measured along an outer surface of the lamp bulb (Yt) and is a minimum value of a distance between each other, of a value that is selected from within a region of the inter-electrode distance (Le) where a minimum value of power that generates the narrowly-defined contracted discharge increases or saturates to increase when the inter-electrode distance (Le) is increased, the minimum value of power being determined according to the inter-electrode distance (Le).

3. The excimer lamp light source device according to claim 1, wherein a ratio of a power value causing the narrowly-defined contracted discharge to a lamp input power value during normal operation is 105% to 120%.

4. An excimer lamp lighting method in an excimer lamp light source device comprising:

an excimer lamp (Y) that has a pair of external electrodes (Ye1, Ye2) configured to induce an electric discharge in a discharge space (Yg) of a lamp bulb (Yt) and to cause a discharge current to flow in a tube axis direction of the lamp bulb (Yt), that does not have an internal electrode, and that generates UV light in the discharge space (Yg) by the discharge, the lamp bulb (Yt) enclosing the discharge space (Yg) filled with a discharge gas configured to generate xenon excimer molecules, having a shape in which both ends of a tubular body are hermetically sealed, and having an easily dischargeable substance layer (Yo) that facilitates a discharge formed on at least a part of a surface that is in contact with the discharge space (Yg); and an inverter (Ui) having a transformer (Tf) equipped with a secondary winding (Ls) to which the external electrodes (Ye1, Ye2) are connected in order to apply a high-voltage alternating current to the excimer lamp (Y), wherein the inverter (Ui) supplies power lower than power that causes a narrowly-defined contracted discharge to the excimer lamp (Y) to light the excimer lamp (Y) in a discharge state that is not the narrowly-defined contracted discharge, the narrowly-defined contracted discharge being a discharge that mainly has a form consisting of one linear discharge path extending from a vicinity of an inner surface portion of the lamp bulb (Yt) facing a portion of the lamp bulb (Yt) in which one of the external electrodes (Ye1, Ye2) is close to or in contact with, to a vicinity of the inner surface portion of the lamp bulb (Yt) facing a portion of the lamp bulb (Yt) in which another of the external electrodes (Ye1, Ye2) is close to or in contact with.

5. The excimer lamp lighting method according to claim 4, wherein a ratio of a power value causing the narrowly-defined contracted discharge to a lamp input power value during normal operation is 105% to 120%.

* * * * *